US005984136A

United States Patent [19]

Mason

[11] Patent Number: 5,984,136

[45] Date of Patent: Nov. 16, 1999

[54] BEVERAGE RECEPTACLE STABILIZER

[76] Inventor: Daniel J. Mason, 17 Richmond Ave., Cranford, N.J. 07016

[21] Appl. No.: 08/635,542

[22] Filed: Apr. 22, 1996

Related U.S. Application Data

[63] Continuation of application No. 08/330,560, Oct. 28, 1994, abandoned.

[51] Int. Cl.[6] ..... B65D 21/00

[52] U.S. Cl. ..... 220/737; 220/23.83; 220/23.86

[58] Field of Search ..... 220/737, 738, 220/23.83, 23.86

[56] References Cited

U.S. PATENT DOCUMENTS

| | | | |
|---|---|---|---|
| 2,916,180 | 12/1959 | Alger | 220/23.86 |
| 3,089,317 | 5/1963 | Bufalini | 220/23.83 X |
| 3,250,422 | 5/1966 | Parish | 220/23.83 |
| 3,401,858 | 9/1968 | White et al. | 220/23.86 X |
| 4,785,959 | 11/1988 | Kleiner | 220/23.86 X |
| 4,836,403 | 6/1989 | Blackman | 220/23.83 X |
| 5,346,070 | 9/1994 | McSpadden | 220/23.86 X |

*Primary Examiner*—Steven Pollard
*Attorney, Agent, or Firm*—Jones Volentine, LLP

[57] ABSTRACT

A device for placement on a office desk or in the home that helps prevent beverages from being spilled. The device has a beverage container receptacle portion that is wide enough to accept various sized beverage containers and is notched to accept mug handles or allow for the insertion and withdrawal of cups or cans. The receptacle portion of the device is attached to a stabilizing portion that is wide and flat to aid in stabilizing the entire device. Also the stabilizing portion is thin enough to be slipped under a computer, typewriter, blotter or other piece of office equipment to aid in stabilization.

3 Claims, 2 Drawing Sheets

BEVERAGE RECEPTACLE STABILIZER

This is a continuation of application Ser. No. 08/330,560 filed Oct. 28, 1994.

FIELD OF THE INVENTION

This invention relates generally to the holding of articles such as beverage containers typically used in the office or a home-office. The purpose of the invention is to prevent beverage containers from being spilled and to ensure that this invention will remain in the office as an advertisement.

In particular, the invention is inserted under a desk top computer, typewriter, blotter, or other object to add stability, and the receptacle end is notched to accept drink containers of different sizes and handles.

BACKGROUND OF THE INVENTION

The office workplace is an area well known to find beverage containers such as cans of soda, mugs of coffee, styrofoam cups of coffee and the like. Typically a desk does not have a built in receptacle to accept these beverage containers, such as is sometimes found in autos, boats or patio furniture. Very commonly, these beverages containers will be knocked over and their contents spilled onto the desk, causing damage or stains. Therefore, there is a need for a beverage container receptacle that will accept beverage containers of different sizes on a desk top that will keep the beverage containers from being spilt when accidentally knocked or hit.

SUMMARY OF THE INVENTION

A beverage container receptacle in accordance with the present invention has a first piece that is long, flat, and thin, preferably it is longer than it is wide, more preferably it is twice as long as it is wide. This first piece should act as a stabilizer, preferably tapered on one end. The invention should have a second piece smaller than the first piece and which has a bottom portion that joins the top portion of the first piece. Such joining can be accomplished by either manufacturing the two pieces as a whole or joining the two pieces later using heat, glue or the like. The second piece is wide enough to accept beverage containers, preferably wide enough to accept cans and styrofoam, paper or plastic cups, and most preferably wide enough to accept mugs. The second piece is notched, preferably at least once, and preferably the notch is wide enough to accept random sized mug handles, and more preferably to allow the insertion and withdrawal of styrofoam, paper or plastic cups. A given notch should be deep enough so that the mug handle does not rest on the notch, thereby allowing the mug to rest flat. The height of the side of the second piece should be tall enough to restrain a standard 12 oz. soda can from tipping over, and yet short enough to allow for easy insertion and withdrawal of a standard size coffee mug or a 7 oz. styrofoam cup.

BRIEF DESCRIPTION OF THE EMBODIMENT

DETAILED DESCRIPTION OF THE INVENTION

Figure 1:
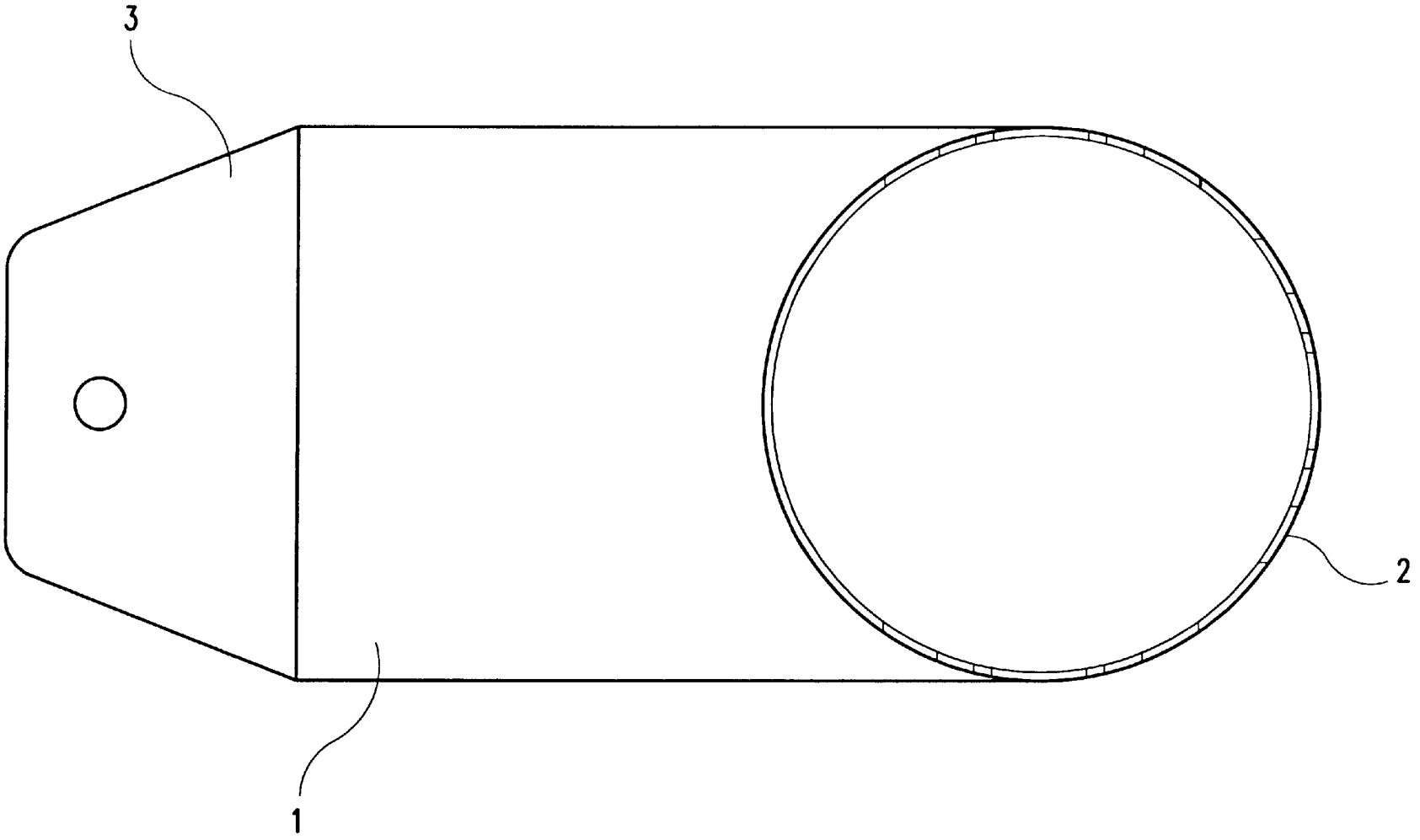
FIG. 1 is a top plan view of the beverage container receptacle of the invention.

Referring now to FIG. 1 of the drawings, there is shown a preferred embodiment of the inventive beverage container receptacle. This embodiment comprises a stabilizing member 1 and, attached to one end thereof, a receptacle member 2. The stabilizing member and receptacle member may be made of any suitable material known to those skilled in the art, such as wood, metal or plastic. Preferably, stabilizing member 1 and receptacle member 2 are comprised of rigid or semirigid plastic having a good impact resistance and high flexural modulus, such as ABS (acrylonitrile butadiene styrene) or polycarbonate. Most preferably, stabilizing member 1 and receptacle member 2 are comprised of plastic resin.

The receptacle member 2 may be attached to the stabilizing member 1 by any means known to those in the art. Such joining can be accomplished, for example, by manufacturing the two members as a whole, or the two members can be joined later using a suitable means like adhesive, such as cement or glue, heat fusion, or the like. Preferably, because of cost concerns, when made of a suitable material such as plastic, the receptacle member and stabilizing member are glued together.

The stabilizing member 1 is preferably in the shape of a rectangle having rounded corners. In such an embodiment, the width of the stabilizing member is preferably about equal to the external diameter of the receptacle member. In a particularly preferred embodiment, the stabilizing member is about 9 inches long and about 3¾ inches wide.

The stabilizing member is sufficiently thin to friction fit between the surface of a desk and a common desktop object, such as a blotter, a personal computer, a typewriter or the like, but not disturb the stability of the common desktop object. Preferably, the stabilizing member is about 1/16 of an inch to about 1/32 of an inch thick, as shown in FIG. 2.

Most preferably, the width of the stabilizing member also tapers over the terminal 2 inches of the end opposite the receptacle member from about 3¾ inches to about 2⅛ inches, to form a tongue 3 at the end opposite the receptacle member 2. In a most preferred embodiment of the invention, the tongue has a center hole for hanging the inventive device from a nail, hook or the like.

The receptacle member 2 is preferably in the shape of a hollow cylinder. The internal diameter of the cylinder is sufficiently large to accept a beverage container, such as a mug, can, styrofoam cup, glass or the like. Most preferably, the cylinder has an internal diameter of about 3⅝ inches and an outside diameter of 3¾ inches. The sides of the cylinder 6 are sufficiently high so as to prevent a drinking vessel from being spilled, but at the same time sufficiently low so as to allow vessels to be placed into and removed from the receptacle member. Preferably, the sides are about 3 3/16 inches high.

Figure 2:
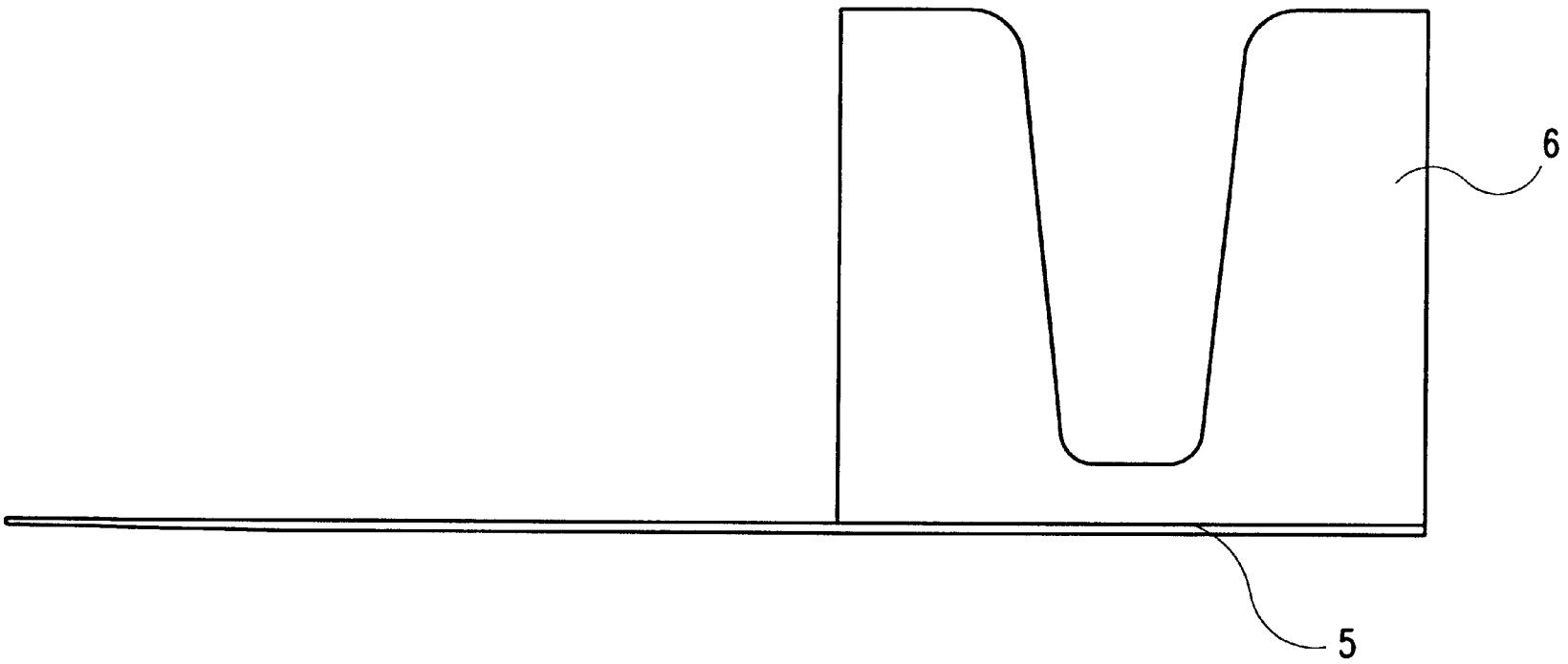
FIG. 2 is a side view of the beverage container receptacle of the invention.

In a particularly preferred embodiment of the device as shown in FIGS. 2 the sides of the receptacle member 6 have at least one notch to accept the handle of a drinking vessel such as a mug. The notches are sufficiently deep to allow the bottom of the vessel to rest against the bottom of the receptacle member 5. Preferably, the sides of the receptacle member have a plurality of notches; more preferably, the sides have 3 notches. In a particularly preferred embodiment, the notches are about 2 13/16 inches deep and about ⅞ of an inch wide.

Although preferred embodiments of the invention are described here in detail, it will be understood by those skilled in the art that variations may be made thereto without departing from the spirit of the invention or the scope of the appended claims.

The article may be made of suitable materials by any methods known by those skilled in the art. Preferably by injection molding of plastic resin or other practical methods.

Having described the invention I claim:

1. A beverage receptacle stabilizer for placement on a horizontal surface, comprising:

a stabilizing first piece in contact with said horizontal surface and joined at a first end to a bottom portion of a beverage container receptacle second piece, said stabilizing first piece being substantially elongated, thin, and flat, and having a second end with a cross sectional thickness that is less than a cross sectional thickness of the first end, such that said stabilizing first piece is tapered along its length, and said beverage container receptacle second piece being wide enough and tall enough to accommodate various size beverage containers.

2. A beverage receptacle stabilizer for placement on a horizontal surface, comprising:

a stabilizing first piece in contact with said horizontal surface and joined at a first end to a bottom portion of a beverage container receptacle second piece, said stabilizing first piece being substantially elongated, thin, and flat, and wherein said stabilizing first piece has a second end with a cross sectional thickness that is less than a cross sectional thickness of the first end, such that said stabilizing first piece is tapered along its length, and said beverage container receptacle second piece being wide enough and tall enough to accommodate various size beverage containers, said beverage container receptacle second piece having at least one substantially narrow notch beginning at a top portion of said second piece and ending in close proximity to the bottom portion, said substantially narrow notch being wide enough to accommodate standard cup or mug handles.

3. The beverage container receptacle of claim 2, wherein said substantially narrow notch is approximately of finger width to allow for insertion and removal of cans or styrofoam cups.

* * * * *